United States Patent [19]

Görner et al.

[11] Patent Number: 4,592,259

[45] Date of Patent: Jun. 3, 1986

[54] METHOD FOR CONTROLLING THE POSITION OF THE CUTTING EDGES OF LONGITUDINAL WEB CUTTING BLADES AND A LONGITUDINAL CUTTING APPARATUS UTILIZING THE SAME

[75] Inventors: Bernd Görner, Weilheimm/Teck, Heinz Zeyher, Reichenbach Fils, both of Fed. Rep. of Germany

[73] Assignee: Beloit Corporation, Beloit, Wis.

[21] Appl. No.: 731,775

[22] Filed: May 8, 1985

[30] Foreign Application Priority Data

May 9, 1984 [DE] Fed. Rep. of Germany ..... 3417042
May 9, 1984 [DE] Fed. Rep. of Germany ..... 8414042

[51] Int. Cl.[4] ..... B26D 1/24

[52] U.S. Cl. ..... 83/13; 83/71; 83/499; 83/508.3

[58] Field of Search ..... 83/13, 71, 499, 504, 83/508.3, 481; 33/186, 185 R

[56] References Cited

U.S. PATENT DOCUMENTS

| | | | |
|---|---|---|---|
| 3,176,566 | 4/1965 | Patterson, Jr. . | |
| 3,886,833 | 6/1975 | Gunn et al. | 83/499 |
| 4,072,887 | 2/1978 | Buschmann et al. | 83/499 X |
| 4,188,846 | 2/1980 | Jones et al. | 83/499 |
| 4,283,981 | 8/1981 | Trautmann | 83/499 X |
| 4,380,945 | 4/1983 | Guild et al. . | |

FOREIGN PATENT DOCUMENTS

| | | |
|---|---|---|
| 961407 | 1/1975 | Canada . |
| 2142117 | 1/1978 | Fed. Rep. of Germany . |

*Primary Examiner*—Frank T. Yost

*Attorney, Agent, or Firm*—Hill, Van Santen, Steadman & Simpson

[57] ABSTRACT

A method for positioning coacting circular cutting blades in a slitting device for a web of material characterized by moving the pair of blades which are mounted on separate carriages along rails extending transverse to the direction of movement of the web being cut to a predetermined position, and locking the carriages of the blades in this predetermined position with the method including compensating for changes in the width of the cutting blade due to sharpening and grinding by measuring the distance of the cutting edge of the blade from a bench mark on the carriage, comparing this distance to a standard to form an offset amount and using the offset amount to correct the amount of movement of the carriage so that the blades are positioned on the desired cutting line. The invention is also directed to the apparatus of a web slitting device having an arrangement of sensors to determine the distance of the cutting edge of the blade from a bench mark on the carriage for the blade and utilizing this distance to determine the offset amount used in positioning the carriage.

10 Claims, 13 Drawing Figures

METHOD FOR CONTROLLING THE POSITION OF THE CUTTING EDGES OF LONGITUDINAL WEB CUTTING BLADES AND A LONGITUDINAL CUTTING APPARATUS UTILIZING THE SAME

BACKGROUND OF THE INVENTION

The present invention is directed to an improved method for positioning cutting edges of a pair of circular cutting blades of a longitudinal cutting or slitting device for web paper or the like.

A longitudinal slitting apparatus and a method of positioning the coacting cutting edges of a pair of circular cutting blades is disclosed in German Letters Patent No. 21 42 117. As disclosed, a carriage with a circular cutting blade or knife is shifted by a conveyor arrangement into predetermined positions which correspond to the desired width for sub-webs which are to be slit or cut from a wide paper roll. As long as the position of the cutting edges or surfaces of the circular knives remain invariable relative to the carriage, this positioning can be arbitrarily repeated and the widths of the sub-webs can be set with a tolerance given by the working precision of the conveyor means or device.

Since the stress and the wear due to the paper web passing through the coacting cutting edges with a speed up to 2500 meters per minute is considerable, the circular knives or blades must be reground from time-to-time. This is particularly true for the driven or so-called bottom blade which is designed pot-like as a cylindrical member with the end surface of the member coacting with a relatively flat so-called top cutter. During regrinding, this end surface is ground off so that the pot or cylindrical member becomes smaller along the axial direction of the blade. The amount of reduction in the axial length for each sharpening or grinding operation is in the range of 1 to 2 millimeters.

When positioning is restricted to bringing the carriages to a specific location, the position of the cutting edges relative to the carriages will be changed. Dislocation enters into the width of the sub-webs produced and thus deviates from the rated dimension by a corresponding amount.

This is inadmissible in many instances. It is known to compensate for the change in the position of the cutting edges due to grinding with shims. This method wastes time and is subject to error because the needed shims must be determined by means of measurements which must be undertaken with each pair of blades and errors due to tolerances will still remain.

SUMMARY OF THE INVENTION

The object of the present invention is to provide an improved method and an improved longitudinal cutting or slitting apparatus wherein the positioning of the cutting edges of the circular knives is possible even after regrinding thereof in a simple fashion without requiring shims and nonetheless will provide a great reliability in obtaining the exact position for the cutting edges.

This object is achieved with an improvement in a method of positioning a cutting edge of a pair of circular cutting blades of a longitudinal cutting device for webs of paper and the like, said cutting device having a frame with a pair of rails on each side of the web and transverse to the direction of movement of the web, each of the pair of blades being mounted in a carriage releasably secured to the rails and transport means for moving the carriages along the rails to obtain a desired position from a bench mark on the frame of the device, the method including shifting each of the carriages for the blades a predetermined distance from a bench mark to obtain a fixed position of the coacting cutting edges from the bench mark and locking the carriages in this position, the improvement comprising measuring the distance of the cutting edges of one blade from a bench mark of its carriage and using this distance to modify the predetermined distance of movement of the carriage to compensate for variations in the width of the one blade.

As in known devices, the positioning of the carriage will occur by setting the interval between the bench mark of the apparatus and the bench mark of each carriage. The position of the cutting edge which is changed by the grinding, however, is determined by means of a measurement which is taken into consideration while positioning the carriage to obtain the desired spacing between the bench mark of the carriage and the bench mark of the apparatus so that the carriage is placed at a different position such that the position of the cutting edge again assumes its desired position and the width of the sub-web produced is not influenced by the regrinding.

This will all occur by means of a measurement to determine changes in the thickness of the blade after grinding and adjusting the amount of movement of the carriage in view of changes in the measured value or distance. Thus, errors that occurred in selection of the correct size of shims and the tolerances that occurred are no longer present.

In order to practice the improved method, the invention also is directed to an improved apparatus for longitudinally slitting and cutting a web of material, said apparatus having a pair of rails mounted on a frame on each side of the web to extend transversely to the direction of movement of said web; a bench mark on the frame; at least one cutting unit, each cutting unit having a first circular cutting blade and a second circular cutting blade with coacting cutting edges, a first carriage for mounting the first blade for rotation and being secured to one of the pair of rails and a second carriage mounting the second blade for rotation and being secured to the other rail of the pair of rails; and transport means for moving both the first and second carriages of each unit along their respective rails to position the coacting cutting edges a predetermined distance from the bench mark, the improvements comprising means for compensating for different axial thicknesses of the first cutting blade including a carriage bench mark on each first carriage, means for measuring the axial distance between the carriage bench mark and the cutting edge of the first blade and means for adjusting the distance of displacement of the first and second carriages by the transport means in response to changes in the axial distance to obtain the predetermined distance of the coacting cutting edges from the bench mark of the frame. The carriage bench mark is preferably established by a reference edge on the first carriage. This reference edge may be formed by a measuring piece which is secured to a portion of the carriage and the measuring piece will have the same distance from the axis of the circular blade as the periphery of the blade.

In the method, the distance between the carriage bench mark and the cutting surface or edge of the first blade is measured and compared to a standard distance which may be the distance when the first blade is brand new prior to any use, resurfacing and/or sharpening.

The measuring is preferably done by a sensor, which is allocated for each cutting unit and stationarily mounted on the apparatus. The sensor will emit electrical signals as the reference edge and the cutting edge pass therebeneath during displacement of the carriage. These pulses can be employed for determining the spacing and/or axial distance between two edges. Thus, after sharpening of the blade by grinding a cutting surface, it is remounted on the carriage and the blade and bench mark of the carriage are then passed by the sensor to generate pulses to determine a new spacing. This new spacing is compared to the old spacing or distance to determine the amount of the blade which has been removed by the grinding or resurfacing operation.

In all known prior art, embodiments of sensors can be utilized for creating the sensing pulses. For example, the sensor may be an inductive or magnetic sensor, a photoelectric sensor, a pneumatic sensor or a mechanically actuated sensor which utilizes a microswitch that is tripped by each of the respective edges.

Since it is necessary to determine the distance between each of the first blades and the bench mark of the first carriage for each of the cutting units, it is necessary that the electronic control means, which has a memory, a comparator and a counter, be able to differentiate between pulses from each of the sensors to determine which cutting unit is being measured. To accomplish this, a sensor is provided for each of the cutting units and the spacing or position of the sensor from the bench mark and edges of each carriage, when the carriages are at a fixed spacing from the apparatus bench mark, is different so that as the plurality of first carriages are moved along the rail, pulses from the sensors for each of the first carriages occur in a given sequence that enables allocating these pulses to the specific carriage. In this fashion, the signals of the individual position sensors can be separated from one another and be allocated respectively to the specific unit. The signals which appear in a predetermined displacement range of positions of the conveyor or transport means can only be derived from a definite pair of surfaces for a given unit.

DESCRIPTION OF THE PREFERRED EMBODIMENTS

Figure 1:
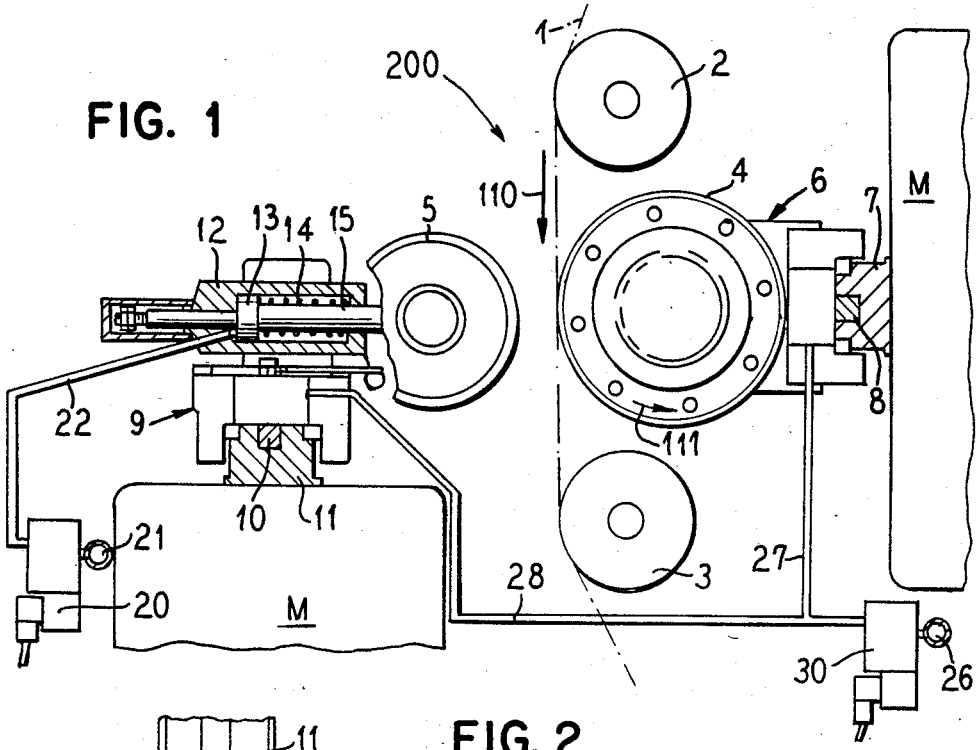
FIG. 1 is a side view illustrating a cutting unit of an apparatus in accordance with the present invention for slitting or cutting a web with portions broken away for purposes of illustration.

The principles of the present invention are particularly useful as slitting apparatus generally indicated at 200 in FIG. 1 for slitting and longitudinally cutting a moving sheet or web 1 which runs between two deflection rollers 2 and 3 that are mounted on a machine frame M of the apparatus 200. As illustrated, the web 1 runs vertically in the direction of an arrow 110 through the apparatus and is longitudinally cut by the apparatus to form sub-webs. The supply reel for the web 1 and the sub-reels for the sub-webs are not shown.

The division of the web occurs by means of a cutting or slitting unit utilizing interacting circular knives or blades, namely, a so-called bottom blade 4 and a top cutter or blade 5. The bottom blade 4 is mounted on a first carriage 6 that is guided on a rail 7 that is connected to a part of the machine frame M. As illustrated, the rail 7 extends transverse to the direction of movement for the web as indicated by the arrow 110 and on one side of the web. In order to displace or move the carriage 6 along the length of the web, a conveyor rod 8 of a transport means is provided in a slot in the rail 7 and is displaceable along the length of the rail. The carriage 6 has means to be discussed hereinafter for selectively connecting it to the conveyor rod 8 in order to displace it along the rail 7 and also to secure it to the rail 7 at any desired positions on the rail.

Figure 2:
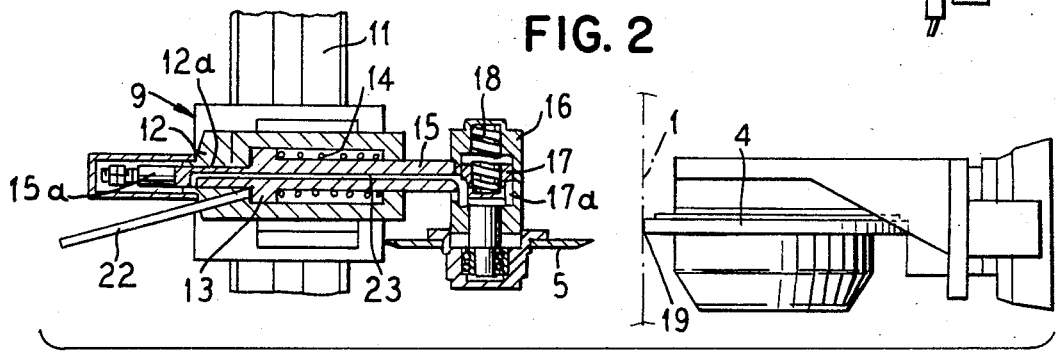
FIG. 2 is a plan view of the cutting unit of FIG. 1 with portions of the apparatus removed and portions of the cutting unit broken away for purposes of illustration.

The bottom blade 4 is rotated in the direction of the arrow 111 by a motor 35 (FIG. 4) while the top cutting blade 5 is not driven but merely is free to rotate. The top cutting blade 5 (FIGS. 1 and 2) is mounted for rotation in a second or top carriage 9 which like the bottom or first carriage 6 is also displaceable by a conveyor rod 10 along a rail 11 secured to the machine frame M to extend on the opposite side of the web 1 and transverse thereto. The second carriage 9 includes a pneumatic piston/cylinder unit 12, which has a piston 13 urged to the left as illustrated in FIGS. 1 and 2 by a spring 14. The piston 13 has a rod 15 which terminates in a second or further piston/cylinder unit 16 (FIG. 2) having a piston 17 urged downward by a spring 18. The piston rod 15 has a passage 23 that extends from a chamber **17*a* for the piston 17 to a port in a stem 15*a* which is slidably received in a bore 12*a* of the housing for the piston/cylinder unit 12**.

The piston cylinder unit 12 will control the adjustment of the top cutter or second cutter blade 5 against the bottom blade 4 and the piston cylinder unit 16 produces the seating of the top cutter blade 5 against a cutting surface 19 of the bottom blade 4 with the prescribed cutting pressure. The control acts in the following manner. A solenoid valve 20 (FIG. 1) is provided for each of the top or second cutting blades 5 of each cutting unit. The solenoid valve 20 controls passage of compressed air from a feed line 21 into a line 22. The line 22 discharges into the cylinder of the piston cylinder unit 12 to act on the piston 13 to urge it against the spring 14 to shift the blade 5 toward the first or bottom blade 4. Thus, the compressed air will shift the blade to the right as illustrated in FIGS. 1 and 2. When the blade displacement has been carried out, the port in the stem 15*a* will come into communication with the compressed air in line 22 as it moves out of the bore 12*a* so that air can move into the chamber 17*a* to act on the piston 17 to force it against the spring 18. This causes the cutter 5 to move into engagement with the cutting surface 19 of the bottom blade 4. Due to the arrangement of the port in the stem 15*a*, the actuation sequence will always prevent the top cutter 5 from striking against the circumference of the bottom blade 4.

A solenoid valve 30 (FIG. 1) is provided for each of the cutting units and controls the initiation of the locking of the respective carriages 6 to the rail 7 and the carriage 9 to the rail 11. Locking will occur when the valve 30 allows compressed air from a line 26 into lines 27 and 28, respectively. The locking and unlocking means will be explained in greater detail with regard to FIGS. 6 and 7 but is of such a nature that it either releases the carriages 6 and 9 from the respective rails 7 and 11 and simultaneously couples the carriages to the conveyor rods 8 and 11 or it uncouples the carriages 6 and 7 from the conveyor rods 8 and 11 and locks them in their respective positions on the rails 7 and 11. The actuating of the locking and unlocking feature is controlled by the solenoid valve 30 so that the locking and unlocking occurs simultaneously for both carriages of the unit.

Figure 3:
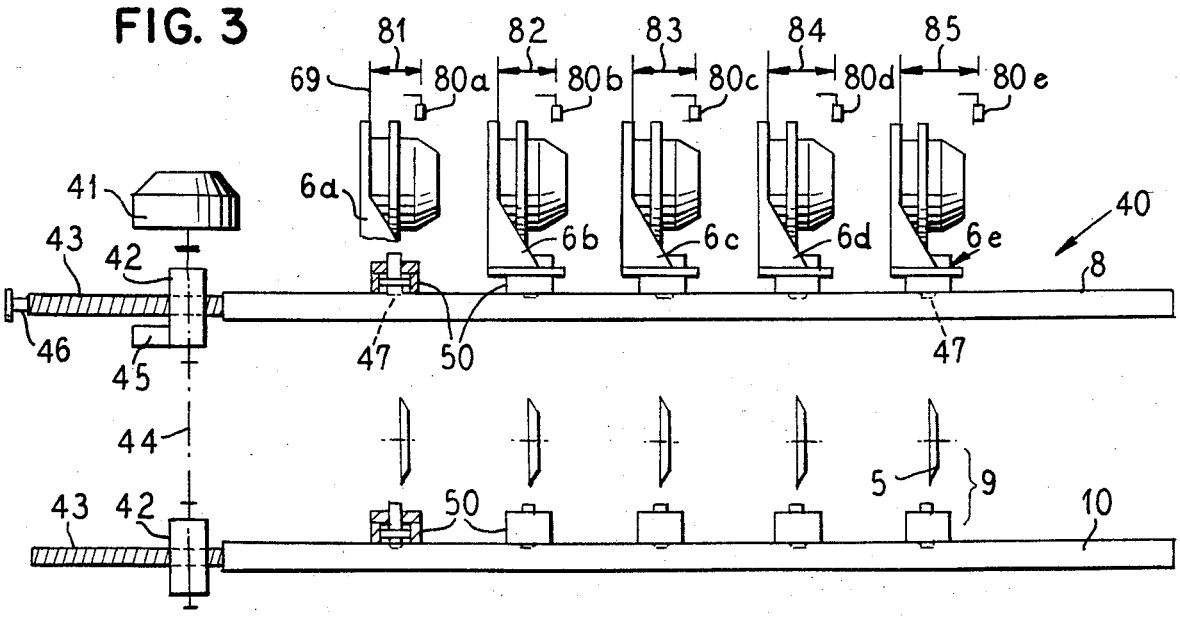
FIG. 3 is a schematic view illustrating a plurality of cutting units and on a transport arrangement for shifting the positions of the cutting unit transverse to the direction of movement of a web through the device.

The number of carriages 6 and 7 as well as the number of cutting units will determine the number of longitudinal divisions or sub-webs formed in the web 1. As schematically illustrated in FIG. 3, five units with carriages 6*a*, 6*b*, 6*c*, 6*d* and 6*e* are provided wherein the top carriages 9 are only indicated by means of the locking and unlocking fixtures 50 and by the top cutting blade 5. Transport means generally indicated at 40 including the conveying rods 8 and 10 will simultaneously displace the blades 4 and 5 of a unit along the respective rail. The conveyor rods 8 and 10 are displaced in a longitudinal direction of each of the rails by a motor 41 which operates by a worm gearing 42 and a ball caster spindle 43. The worm gearing 42 of both conveyor rods 8 and 10 is connected to one another via an articulated shaft 44 so that the conveyor rods 8 and 10 and thus the carriages 6 and 9 are always displaced by an identical amount along the rails 7 and 11.

A pulse generator 45 will resolve the transport motion of the conveyor 8 of the transport means into discrete pulses and is situated at the worm gearing 42 for the conveyor rod 8 for the bottom blades 4. Every counted pulse will correspond to a specific distance for the transport path of the blades.

At the beginning of the positioning method, the conveyor rod 8 is pulled back against a zero stop which is represented by a bench mark 46 of the frame for the apparatus. The carriages 6*a*–6*e* are thereby situated in their starting position which are established by the spacing of index bores 47 along the length of the conveyor rod 8 and the spacing of index bores 47 in the desired spacing of the units for slitting the web into subwebs. Cogs or projections of locking and unlocking fixtures 50 will become engaged in these index bores and the design of these fixtures will be explained later with regard to FIGS. 6 and 7.

If all of the blades 4 have a standard width, the carriages 6*a*–6*e* are then coupled to the conveyor rod 8 by having the respective fixture 50 having its projection engaged in the particular index bore 47 of the conveyor rod 8. With the conveyor rod 8 starting in a zero position against the zero stop or bench mark 46 and a counter at zero, the motor 41 is operated. After a specific number of pulses of the pulse generator 45 have occurred, the conveyor rod has covered a corresponding distance and the carriages 6*a*–6*e* have then reached their desired position. When in the desired position, the carriages 6*a*–6*e* are uncoupled from the conveyor rod 8 and locked or secured to the rail 7. This procedure is executed such that the conveyor rod 8 executes only a single stroke for positioning of all the carriages 6*a*–6*e*. Thus, all the carriages are coupled to the rod 8 while it is in the starting position and are left positioned at their preselected positions after the movement of the rod.

The top or second cutter blades and their respective carriages 9 are also moved accordingly. Thus, the carriages 9 of each of the unit are also shifted to their new position for interaction so that the blades 5 can interact with the blade 4 of the unit.

Figure 4:
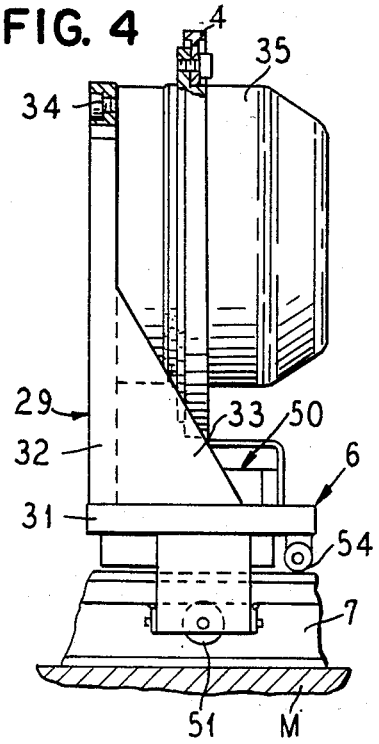
FIG. 4 is an enlarged end view with portions broken away for purposes of illustration of a bottom blade carriage of a cutting unit in accordance with the present invention.
Figure 5:
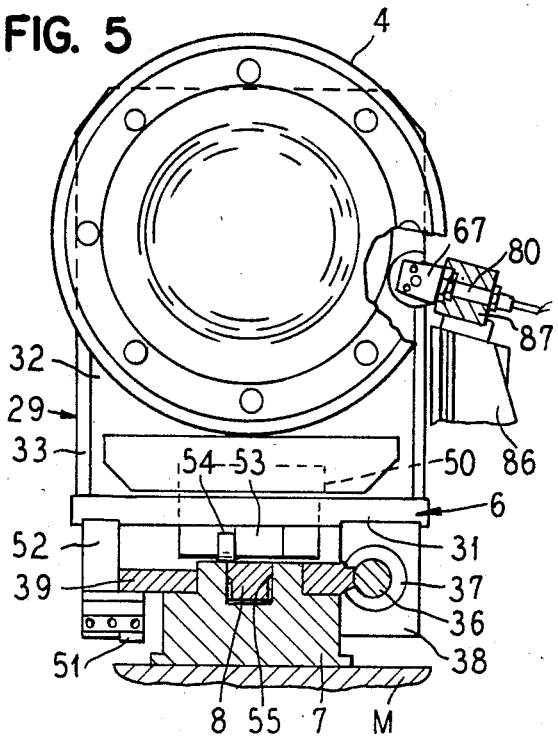
FIG. 5 is an enlarged side view with portions broken away for purposes of illustration of the carriage of FIG. 4.

The bottom blade carriages 6 are best illustrated in FIGS. 4 and 5 and have a motor carriage 29 which comprises a base plate 31 extending parallel to an upper surface of the rail 7 as well as a supporting plate 32 extending perpendicular to the plate 31 and connected by reinforcing angles 33. A blade motor 35 is secured to the supporting plate 32 by screws such as 34.

As best illustrated in FIG. 5, the rail 7 on a surface opposite the machine frame M has a guide rod or rail 36 which has a substantially circular cross-section. This guide rod extends over the entire length of the rail 7 and receives a ball-type bushing 37 which is mounted in a cleat or member 38 on the underside of the base plate 31. A guide strip 39 is positioned on the opposite side of the rail which is illustrated as being on the left side in FIG. 5. A roller 51 which is carried by a member 52 which is likewise secured to the underside of the base plate 31 engages a bottom surface of the guide strip 39. Thus, the carriage is guided in a longitudinal direction by the guide rod 36 and is supported against the rotation on the guide rod by means of the roller 51. So that the carriage, however, while rotating toward the left, does not lie against the front side of the rail 7 and drag along it, an additional roller 54 is provided on a pedestal 53 and runs along an upper surface of the rail 7 adjacent to the groove or slot 55 which receives the conveyor rod 8. As mentioned before, the rod 8 is displaceable along the length or axis of the rail 7 in the slot or recess 55.

Figure 6:
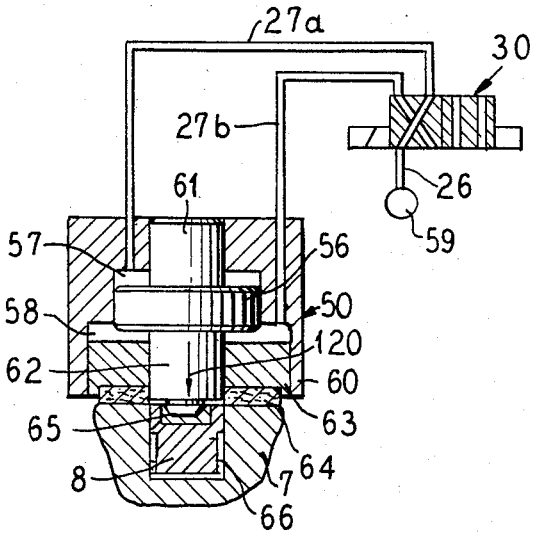
FIGS. 6 and 7 are enlarged cross-sectional views of a locking arrangement for a blade carriage with FIG. 6 showing the blade carriage attached to the transport arrangement and FIG. 7 illustrating the locking arrangement for securing the blade carriage to a rail of the frame of the apparatus.
Figure 7:
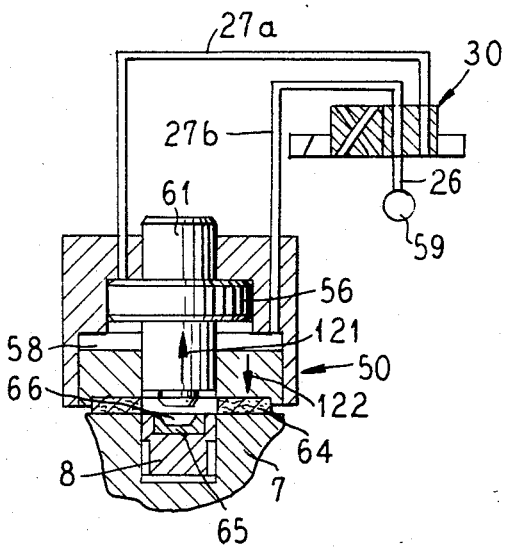

The locking and unlocking fixture 50 as illustrated in FIGS. 4 and 5 is mounted in the plate 31 and positioned over the rail 7 and its corresponding rod 8. As best illustrated in FIGS. 6 and 7, the fixture 50 has a piston/-cylinder unit comprising a cylinder 60 receiving a piston 56 which has a piston rod 61 extending from one side and a second piston rod 62 protruding from the opposite side. The piston 56 in the cylinder 60 forms two cylindrical chambers 57 and 58. The cylinder chamber 58 is outwardly limited by another piston 53 which is guided in the cylinder 60 and has a center opening through which the piston rod 62 extends. The piston 53 on an outer surface carries a friction lining or member 64 which can be forced against a surface of the rail 7.

As mentioned hereinbefore, the unit or fixture 50 is operated by a solenoid valve 30. As illustrated, compressed air from a source 59 can be selectively connected to the cylinder chambers 57 and 58. As illustrated, the solenoid valve is a two-position valve. When the solenoid valve 30 is in the position illustrated in FIG. 6, the cylinder chamber 57 is connected by line 27*a* to the source of compressed air 59 while the chamber 58 is vented by line 27*b* to the atmosphere. This will cause the piston 56 to be urged downward in the direction of arrow 120 to force a projection or index cog 65 into the index depression 66 of the conveyor rod 8. Thus, as illustrated in FIG. 6, the fixture 50 has coupled the carriage to the rod 8 and in this fashion the carriage 8 will move with the rod 8 as the rod 8 is displaced by the transport means.

When the solenoid valve 30 assumes the position illustrated in FIG. 7, the chamber 58 is now connected by line 27*b* to the compressed air source 59 and the chamber 57 is vented by line 27*a* to the atmosphere. This will cause the piston 56 to move in an upward direction indicated by the arrow 121 to uncouple the projection 65 from the depression or recess 66 of the rod 8. Simultaneously, the piston 63 is pressed down in the direction of arrow 122 to press the friction lining or pad 64 against a surface of the rail 7 to lock or secure the carriage to the rail. Thus, in the condition illustrated in FIG. 7, the carriage is secured or locked to the rail 7 by the friction lining or pad 64 and the index cog or projection 65 is released from the conveyor rail 8.

The determination of the position of a cutting surface or edge 19 of the lower blade 4 is best illustrated in FIGS. 8–12. As illustrated in FIGS. 8–11, a pair of blades 4 and 5 are in cutting engagement wherein the cutting edge of the blade 5 moves along a surface of the blade 4. To form a bench mark on the carriage such as 6, a measuring piece 67 is mounted on the supporting plate 32 of the carriage 6 and has a radial distance 68 from the axis of the blade 4 which is identical to the radius of the blade 4. Therefore, a bench mark or edge 69 of the member 67 is the same distance 68 from the axis of the blade 4 as the cutting edge formed by the surface 19.

Figure 9:
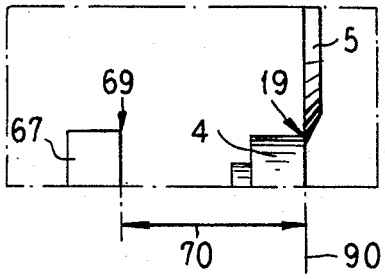
FIGS. 9, 10 and 11 are enlarged views of the region contained in the dot-dash lines of FIG. 8 with FIG. 9 showing the spacing for a new blade, FIG. 10 showing the change in the spacing of a resurfaced or ground blade and FIG. 11 showing the change in the position of the carriage to place the cutting edge of the ground blade in the desired location.
Figure 10:
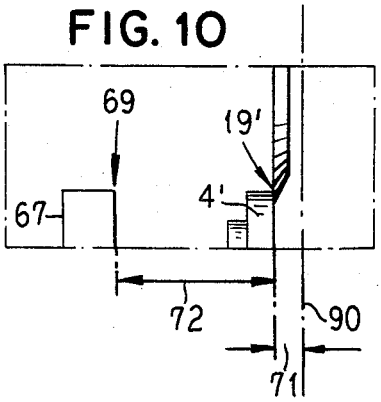
Figure 13:
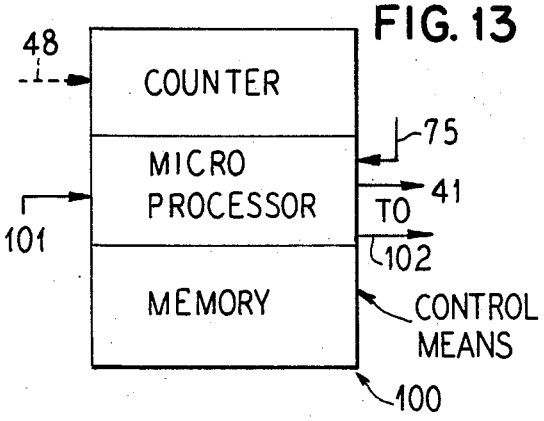
FIG. 13 is an enlarged schematic view of the control means in accordance with the present invention.

As illustrated in FIG. 9, a cutting edge or surface 19 and the reference edge or carriage bench mark 69 have a specific distance 70 from one another when a new blade 4 is mounted on the carriage. Thus, when the carriage 6 is moved to the desired position to place the cutting edges formed by the blades 4 and 6 on a cutting line 90, the bench mark 69 will be in the position illustrated in FIG. 9.

When the blade 4 needs grinding or sharpening, a new cutting edge 19′, of the ground blade 4′ (FIG. 10) and the edge or bench mark 69 will have a distance 72 which is smaller than the spacing or distance 70. The amount or difference is the distance 71 which corresponds to the amount of material which has been removed while resurfacing the surface to form the new edge 19′. It should be noted that in FIG. 10, the thickness 71 has been exaggerated for purposes of illustration and in reality is a matter of 1 to 2 mm. With the ground blade 4′ and the carriage moved to the previous position as the position illustrated in FIG. 9, the cutting edges will be offset from the desired position indicated by the line 90 by the distance 71. Thus, the cut in the paper will occur at a location which is offset from the desired position by an amount equal to the distance 71.

Figure 11:
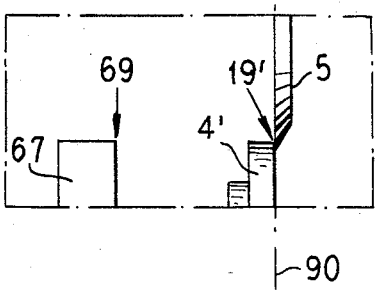

In order to prevent this, the amount 71 is automatically incorporated into a control means 100 to move the carriage 6 this additional amount so that the cutting edge 19′ of the ground blade 4′ will again be on the line 90 as illustrated in FIG. 11. To accomplish this, a position sensor 80 (FIG. 8) will emit a signal when each of the edges 19 and 69 pass thereby. As illustrated in FIG. 5, the sensor 80 is positioned immediately outside of the measuring piece 67 by being supported by a strip 87 that is supported by a frame member such as 86 which extends the width of the device.

Figure 8:
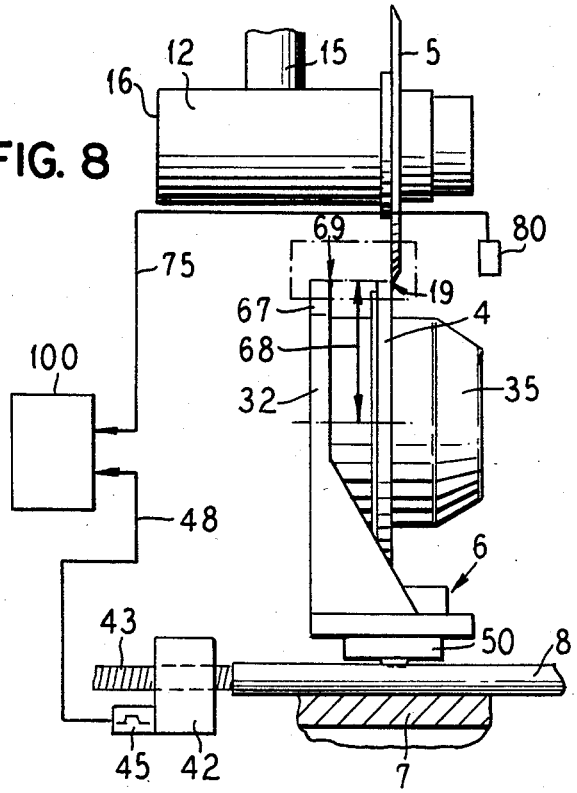
FIG. 8 is an enlarged view similar to FIG. 2 of a cutting unit in accordance with the present invention.
Figure 12:
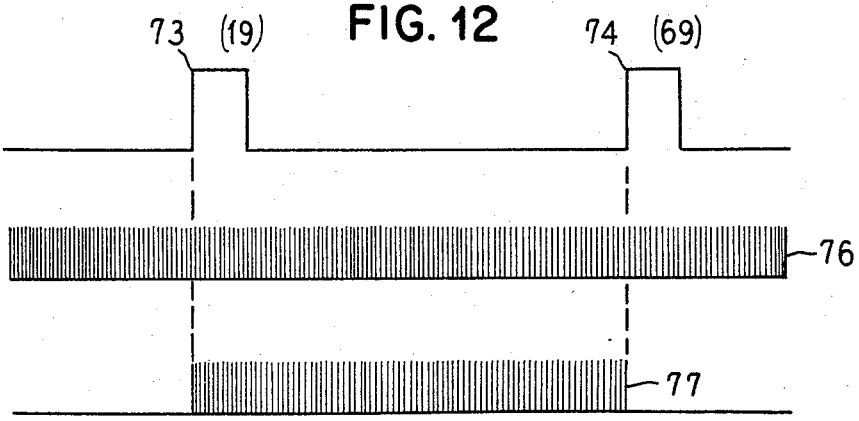
FIG. 12 is a schematic illustration of the different pulses utilized for measuring the distance in accordance with the present invention.

As mentioned hereinabove, after the lower blade has been replaced either with a new blade or has been ground and replaced as the blade 4′ on the carriage 6, the carriage is moved past the position of the sensor 80 in a direction proceeding from right to left as illustrated in FIG. 8. A signal 73 (19) which is produced as the cutting edge 19 passes the sensor 80 is created and when the sensor passes the bench mark or edge 69, a second signal 74 (69) is produced. These signals are illustrated in FIG. 12 as square waves with the leading edge occurring as the edge passes the sensor. The signals are applied on a line 75 to a microcomputer or a microprocessor with a memory of a control means 100 which also has a counter to receive the pulses from the pulse generator 45 that are supplied on a line 48. The pulses illustrated at 76 in FIG. 12 are continuous for the movement of the rod 8 from the zero position engaged on the bench mark 46. The microprocessor receives the pulse 73 (19) and reads the counter and also reads the counter when the pulse 74 (69) is received. From these readings, the series of pulses 77 are obtained and the microprocessor calculates or determines the distance or spacing between the edges 69 and 19. A standard value or a reference length, which could be determined by measuring the original distance 70 of the new blade such as 4, has been placed in the memory of the microprocessor. This standard value is compared with a newly determined distance to determine the amount of offset 71 created by a ground blade 4′. The comparison can be done in a comparator unit of the microprocessor of control means 100 and the difference will be added to the amount of displacement of the rod 8 to place the carriage in the desired position to have the cutting edges 19′ on the desired line such as 90. The difference obtained in the comparator can be added to a displacement signal for the particular carriage coming from a line 101 by the comparator so that the combined signal going to the motor 41 is the total distance of movement for the carriage from a zero position.

As a result of the counting and the output from the comparator, the motor 41 does not position the specific carrier 6 in its original position which corresponds to that of FIG. 9 and would yield a deviation 71 of the position of the cutting edge 19 from the desired line cut 90 but moves the carriage a greater distance so that the cutting edge 19 is again placed on the desired cut line 90. When this occurs, the microprocessor sends a signal on a line 102 to actuate the solenoid valve for that carriage to uncouple the carriage and lock it in place in the rail 7.

The correction of the position of the cutting edge 19 will occur automatically. In order for the microprocessor of control means 100 to distinguish between the pulses referenced 73 (19) and 74 (69) in FIG. 12 for each of the five carriages 6*a*′–6*e*, the position sensors 80*a*–80*e* as illustrated in FIG. 3 are not in identically the same relative position to the carriages 6. As illustrated in FIG. 3, with the transport means 40 in a zero position and the carriages 6a–6e in the desired spacing along the rod 8, a sensor 80a for the carriage 6a is at a spacing 81 from the edge 69, a sensor 80b for the carriage 6b is at a spacing 82, the sensor 80c is at a spacing 83, the sensor 80d is at a spacing 84 and the sensor 80e is at a distance or spacing 85. The distance 82 is greater than 81 and the distance 83 is greater than 82, the distance 84 is greater than the distance 83 and the distance 85 for the carriage 6a is greater than the distance 84 for the carriage 6d. Thus, when all the carriages are attached in the index spacings 47, and moved beneath their respective sensors, the carriage 6a will create a pulse 74 (69) after movement of the distance 81. The distances are such that the pulses will be received in a given sequence so that they can be easily allocated to the individual sensors 80a–80e and carriages 6a–6e by the control means 100 and will not overlap.

The operation is such that after a reference distance between the two pulses such as 73 and 74 is stored in the memory, and after a blade has been either replaced with a new blade or has been resurfaced such as the blade 4' and mounted on the carriage, the transport means moves the carriage with the newly changed blade beneath the sensor to measure the distance 72 which is subsequently compared to the standard distance 70 to obtain the offset 71. The offset then is used to adjust the actual movement of the rods 8 and 10 from the zero position to place the carriage in its desired position with the edge 19 on the cutting line 90. When this new position is reached, the solenoid valves 30 are switched from a position coupling the carriages 6 and 9 to the respective conveyor rods 8 and 10 to a position for locking the carriages on their respective rails 7 and 11. While the actuation of the solenoid 30 would be done manually by an operator, the microprocessor of the control means 100 sends a command signal on line 102 be used to cause an automatic actuation of the solenoid 30.

If more than one blade for more than one slitting unit is being replaced, the carriages for each unit are positioned separately since the amount of displacement or offset 71 will not necessarily be the same for the two blades that are resurfaced or ground.

Although various minor modifications may be suggested by those versed in the art, it should be understood that we wish to embody within the scope of the patent granted hereon, all such modifications as reasonably and properly come within the scope of our contribution to the art.

We claim:

1. In a method of positioning cutting edges of a pair of circular cutting blades of a longitudinal cutting device for webs of paper and the like, said cutting device having a frame with a pair of rails on each side of the web extending transverse to the direction of movement of the web, each of the pair of blades being mounted in a carriage releasably secured to the rails and transport means for moving the carriages along the rails to obtain the desired position from a bench mark on the frame of the device, the method including shifting each of the carriages for the blades a predetermined distance from the bench mark to obtain a fixed position of the coacting cutting edges from the bench mark and then locking the carriages in said position, the improvements comprising measuring the distance of the cutting edge of one blade from a bench mark of its carriage and using this distance to modify the predetermined distance of movement for the carriage to compensate for variations in the width of the one blade.

2. In a method according to claim 1, wherein the step of using the distance to modify the predetermined distance includes comparing the recently measured distance to a standard distance to obtain an offset, and utilizing the offset to vary the predetermined distance of movement for the carriage.

3. In an apparatus for longitudinally slitting and cutting a web of material, said apparatus having a pair of rails mounted on a frame on each side of the web to extend transversely to the direction of movement of said web; a bench mark on the frame; at least one cutting unit, each cutting unit having a first circular cutting blade and a second circular cutting blade with coacting cutting edges, a first carriage for mounting the first blade for rotation and being secured to one of the pair of rails and a second carriage mounting the second blade for rotation and being secured to the other rail of the pair of rails; and transport means for moving both the first and second carriages of each unit along their respective rails to position the coacting cutting edges a predetermined distance from the bench mark, the improvements comprising means for compensating for different axial thicknesses of the first cutting blade including a carriage bench mark on each first carriage, means for measuring the axial distance between the carriage bench mark and the cutting edge of the first blade and means for adjusting the distance of displacement of the first and second carriages by the transport means in response to changes in the axial distance to obtain the predetermined distance of the coacting cutting edges from the bench mark of the frame.

4. In an apparatus according to claim 3, wherein the carriage bench mark is formed by a reference edge on said first carriage.

5. In an apparatus according to claim 4, wherein the first carriage has a motor carrier for a motor to rotate the first blade, and wherein said reference edge is a measuring piece secured to the motor carrier of said first carriage, said measuring piece having the same distance from an axis of the first blade as the periphery of said blade.

6. In an apparatus according to claim 5, wherein the means for measuring the axial distance comprises a sensor stationarily disposed on a frame of the apparatus along a path of movement of the first carriage on said rail, said sensor emitting an electric signal as the cutting edge of the first blade and as the reference edge of the first carriage move thereby.

7. In an apparatus according to claim 6 having at least two cutting units each having a sensor for creating an electrical pulse when the cutting edge and reference edge of the carriage passes thereby, said sensors being mounted different distances on the frame so that with the carriages all positioned on the transport means and the transport means in its initial starting position, the edges of each carriage pass below its sensor at a different point of transport to enable a control means of the apparatus to separate the electrical pulses for each carriage and allocate them to the respective carriage.

8. In an apparatus according to claim 7, wherein the difference in the distance of travel for each carriage is an identical amount so that the pulses from the sensors are received in sequence as the transport means moves the carriages beneath their respective sensor.

9. In an apparatus according to claim 3, wherein the means for measuring includes a sensor mounted on the frame in the path of the first carriage being moved by the transport means, said sensor creating an electrical signal when the cutting edge of the first blade passes therebelow and when the bench mark on the first carriage passes thereby, said means for measuring including a pulse generator attached to the transport means for creating a plurality of pulses as the transport means moves the carriages from an initial position and a counter for receiving the pulses of the pulse generator said first of the electrical signals from the sensor starting the counter to count the pulses from the pulse generator and the second signal terminating the counting with the number of counted pulses determining the distance between the cutting edge and the bench mark of the carriage.

10. In an apparatus according to claim 9, wherein the means for adjusting determines the changes in the axial distance by comparing the counted pulses for the blade against a standard to create an error signal and uses the error signal to adjust the distance of displacement of the first and second carriages by the transport means from the bench mark of the frame.

* * * * *